US005452492A

United States Patent [19]

Hamilton

[11] Patent Number: 5,452,492

[45] Date of Patent: Sep. 26, 1995

[54] MATERIAL COLLECTION

[76] Inventor: Robin Hamilton, "Greenbanks", Long Lane, Dalbury Lees, Derby, DE6 5BJ, United Kingdom

[21] Appl. No.: 954,010

[22] Filed: Sep. 30, 1992

[30] Foreign Application Priority Data

Sep. 26, 1992 [GB] United Kingdom ..... 9220382

[51] Int. Cl.[6] ..... A47L 5/00; E01H 1/08

[52] U.S. Cl. ..... 15/340.1; 15/346

[58] Field of Search ..... 15/340.1, 345, 15/346

[56] References Cited

U.S. PATENT DOCUMENTS

| | | | |
|---|---|---|---|
| 3,065,689 | 11/1962 | Gueytron | 100/148 |
| 3,717,978 | 2/1973 | Osborne | 55/242 |
| 3,876,548 | 4/1975 | Welles, Jr. | 210/391 |
| 3,913,307 | 4/1975 | Cardinal, Jr. | 56/328 R |
| 4,019,219 | 6/1977 | Willenborg | 15/339 |
| 4,109,341 | 8/1978 | Larsen et al. | 15/340.1 |
| 4,211,164 | 6/1980 | Fichtl et al. | 100/145 |
| 4,257,728 | 3/1981 | Schmidt | 414/468 |
| 4,294,596 | 10/1981 | Taverez | 55/242 |
| 4,300,261 | 2/1981 | Woodward et al. | 15/345 |
| 4,395,794 | 8/1983 | Duncan | 15/340.1 |
| 4,561,145 | 12/1985 | Latham | 15/346 |
| 4,594,749 | 5/1986 | Waterman | 15/345 |
| 4,858,270 | 8/1989 | Boschung | 15/346 |
| 4,884,315 | 12/1989 | Ehnert | 15/346 |
| 5,013,343 | 5/1991 | Miyamoto | 55/395 |
| 5,114,331 | 5/1992 | Umehara et al. | 425/200 |

FOREIGN PATENT DOCUMENTS

| | | | |
|---|---|---|---|
| 2022470 | 2/1991 | Canada . | |
| 2022365 | 2/1991 | Canada . | |
| 0003806 | 9/1979 | European Pat. Off. | B30B/9/12 |
| 0019538 | 11/1980 | European Pat. Off. | B01D/21/00 |
| 0131063A1 | 1/1985 | European Pat. Off. . | |
| 0288436 | 4/1988 | European Pat. Off. | E01H/6/00 |
| 0331432 | 2/1989 | European Pat. Off. | A47L/5/22 |
| 0342504 | 5/1989 | European Pat. Off. | E01H/1/08 |
| 0301000B1 | 10/1991 | European Pat. Off. . | |
| 0451134A1 | 10/1991 | European Pat. Off. . | |
| 742026 | 10/1943 | Germany . | |
| 2007630 | 8/1971 | Germany | 15/346 |
| 2359200 | 11/1973 | Germany . | |
| 3010441 | 3/1980 | Germany | E01H/1/04 |
| 3441145 | 11/1984 | Germany | E02B/15/00 |
| 3831528A1 | 3/1990 | Germany | B30B/11/24 |
| 153288 | 11/1967 | Netherlands | E01H/1/10 |
| WO82/01115 | 4/1982 | Sweden . | |
| WO87/05619 | 9/1987 | Sweden . | |
| 364803 | 1/1959 | Switzerland . | |
| 613735 | 2/1977 | Switzerland | E01H/1/08 |
| 277028 | 12/1927 | United Kingdom . | |
| 579529 | 8/1946 | United Kingdom . | |
| 1184795 | 11/1966 | United Kingdom | E01H/1/08 |
| 1202831 | 1/1969 | United Kingdom | E01H/1/04 |
| 1243999 | 8/1971 | United Kingdom . | |
| 1483664 | 2/1974 | United Kingdom | A47L/5/12 |
| 1387003 | 3/1975 | United Kingdom . | |
| 2296051 | 7/1976 | United Kingdom . | |
| 2034591 | 6/1980 | United Kingdom . | |
| 1601846 | 11/1981 | United Kingdom . | |

(List continued on next page.)

OTHER PUBLICATIONS

European Search Report; EP 91 30 2559; Dec. 6, 1991.

The United Kingdom Search Report; 9106338.8; May 29, 1991.

Abstract, "Screw Conveyors", Clark Dec. 17, 1940.

*Primary Examiner*—David Scherbel

*Assistant Examiner*—Reginald L. Alexander

*Attorney, Agent, or Firm*—W. Thad Adams, III

[57] ABSTRACT

Waste collection apparatus 10 comprises a first fluid duct 12 having an inlet at 14. A fan 16 creates a first fluid flow path 18 to draw waste material into the inlet 14, for collection A second duct 20 directs air back along the periphery of the flow path 18 to deflect waste material up into the main path 18 Rotating air jets 32 are located near the inlet 14 to sweep an area to either side of the vehicle, to deflect waste material in to the path 18. The apparatus includes a compactor, which can be used alone.

13 Claims, 9 Drawing Sheets

FOREIGN PATENT DOCUMENTS

| | | | |
|---|---|---|---|
| 2132063 | 12/1982 | United Kingdom | E01H/1/00 |
| 2142961 | 5/1984 | United Kingdom | E01H/1/08 |
| 2159093 | 11/1985 | United Kingdom . | |
| 2211227 | 10/1987 | United Kingdom | E01H/1/08 |
| 2201447 | 2/1988 | United Kingdom | E01H/1/08 |
| 2234328 | 7/1989 | United Kingdom | F16H/61/42 |
| 2241524 | 9/1991 | United Kingdom . | |

MATERIAL COLLECTION

FIELD OF THE INVENTION

The present invention relates to the collection, compaction and processing of material, particularly but not exclusively waste material.

BACKGROUND OF THE INVENTION

Efficient, rapid and economic techniques for waste collection are becoming increasingly desirable, in view of the increasing litter problem in many countries. It has previously been proposed to modify vehicles for collecting waste and litter, by providing brushes to sweep the surface over which the vehicle is moving, to deflect litter to a collecting scoop which brings the litter into the vehicle where it is stored for transport to a disposal location. Increasing amounts of litter are very light, some being highly coloured articles such as fast food containers, making the problem clearly visible. Other natural articles such as leaves, are bulky but not heavy. Litter of this sort is commonly referred to as "wind blown" litter because it is easily moved by light wind. Consequently, wind blown litter is easily scattered over a wide area, including areas which are inaccessible to conventional waste collection apparatus, often because the weight of a vehicle when full of litter is so great that the vehicle must be confined to firm surfaces such as metalled or paved areas. Moreover, it is found that brushes on these vehicles do not always deflect wind blown litter towards the collection scoop, but the first contact of the brushes with the litter may deflect the litter away from the vehicle so that an unacceptable proportion of this litter remains uncollected. Brushes are also found to scour away sand or other loose material, and so may loosen flagstones.

The present invention seeks to obviate or mitigate these and other disadvantages of the prior art.

SUMMARY Of THE INVENTION

According to the invention, there is provided waste collection apparatus comprising a first fluid duct having an inlet and means operable to create a fluid flow along the first duct from the inlet, whereby waste material may be drawn into the inlet by the fluid flow and thereafter collected, the first duct being partly defined, in use, by the surface over which the apparatus is moving, and partly by a duct-defining surface or surfaces of the apparatus, and wherein the duct extends generally horizontally from the inlet in a direction generally opposite to the forward direction of the apparatus, the fluid flow means, in use, causing wind blown litter to be drawn across the surface over which the apparatus is moving and along the duct to a location at which the duct turns upwardly into the body of the apparatus, and is thereafter defined entirely by duct-defining surfaces of the apparatus.

The cross-section of the duct may reduce between the inlet and the said location, to cause fluid flowing along the duct to accelerate. Preferably the apparatus further comprises at least one second fluid duct means having an outlet so located and arranged as to create a second fluid flow path which is at the periphery of the first path and is perpendicular to or generally oppositely directed to cause waste material which, in use, is being drawn along the periphery of the first path to be deflected into the main stream of fluid flowing along the first path.

The or one of the second fluid duct means may comprise at least one outlet located in the region of the duct inlet. The second fluid duct means may comprise at least two outlets located opposite one another in the region of the duct inlet. The apparatus may further comprise means for re-orienting the or each outlet at the duct inlet, in relation to the duct, whereby the second flow path can be re-oriented in relation to the first flow path. The or each outlet may be pivotally or rotatably mounted, whereby the second flow path may sweep through a region at the periphery of the first flow path. A plurality of pivotally or rotatably mounted outlets are preferably operable to create respective second flow paths which sweep in succession as aforesaid. The apparatus may comprise means for supplying fluid to the outlet in pulses.

According to a second aspect of the invention, there is provided waste collection apparatus comprising a first fluid duct having an inlet, means operable to create a first fluid flow path towards and into the duct inlet whereby waste material may be drawn into the inlet by the fluid flow and thereafter collected, and wherein the apparatus further comprises at least one second fluid duct means having an outlet so located and arranged as to create a second fluid flow path which is at the periphery of the first path and is perpendicular to or generally oppositely directed to cause waste material which, in use, is being drawn along the periphery of the first path to be deflected into the main stream of fluid flowing along the first path.

The apparatus is preferably adapted to move over a surface and the duct is partly defined by the surface and partly by a duct-defining surface of the apparatus, and the or one of the second fluid duct means may have an outlet in the region of an edge of the duct-defining surface adjacent to the surface over which the apparatus is moving, and the second path may be so directed to deflect waste material from leaving the duct between the edge and the surface over which the apparatus is moving. The portion of the duct which is defined in part by the surface over which the apparatus is moving is preferably generally horizontal and turns upwardly in the region of the said edge, to draw waste material up from the surface.

Preferably the duct inlet is the widest part of the duct, whereby fluid accelerates as it travels along the first path. The or one of the second fluid duct means may comprise at least one outlet located in the region of the duct inlet. The second fluid duct means may comprise at least two outlets located opposite one another in the region of the duct inlet. The apparatus may further comprise means for re-orienting the, or each outlet at the duct inlet, in relation to the duct, whereby the second flow path can be re-oriented in relation to the first flow path. The or each outlet may be pivotally or rotatably mounted, whereby the second flow path may sweep through a region at the periphery of the first flow path. A plurality of pivotally or rotatably mounted outlets are preferably operable to create respective second flow paths which sweep in succession as aforesaid. The apparatus may comprise means for supplying fluid to the outlet in pulses.

Preferably the same fluid flows along both paths. The fluid is preferably air or water.

In a third aspect, the invention provides fluid filter apparatus comprising a filter element, means operable to move the filter element to describe a closed path including first and second positions at which fluid to be filtered passes through the filter element, and fluid guide means operable to define a path for fluid to be filtered, the path passing through the filter element in a first direction at the first position and the fluid guide means guiding at least some of the filtered fluid to the second position at which the fluid may pass through the filter element in the opposite direction, and the apparatus further providing an intermediate cleaning position on the closed path between the first and second positions, the filter element being cleaned as it passes the intermediate position.

The closed path is preferably substantially circular. The filter element may be cylindrically shaped and the drive means may rotate the filter element around the cylindrical axis. The filter element may be flat and the drive means may rotate the filter element around an axis perpendicular to the plane of the filter element. The filter element may extend continuously around the whole of the closed path.

In a fourth aspect, the invention provides waste collection apparatus comprising conveying apparatus for conveying collected waste to an outlet, and constriction means operable to constrict the path of waste to the outlet while the conveying apparatus is in operation, thereby compressing the waste.

The conveying apparatus may be a screw conveyor and/or comprise a ram. The constriction means may be selectively operable to close the outlet. The constriction means may be resiliently biased to close the outlet, thereby compressing waste until the biasing is overcome.

In a fifth aspect, the invention provides waste collection apparatus comprising means operable to form collected waste into packets which are deposited from the apparatus for subsequent collection.

The packets may be bound in a covering material, or placed in a container such as a bag or sack. The waste may be bound to form bails.

A sixth aspect of the invention provides an elongate flexible article comprising a wall which defines within it a space, and a passage within the wall and to which fluid may be supplied at a pressure which is variable to control the flexibility of the article.

The passage may have a fluid inlet and a fluid outlet, whereby fluid is constantly driven through the passage in use, the flexibility being determined by the fluid pressure at the inlet.

The space may be a fluid conveying conduit. The passage may be formed in a wall of the conduit. The conduit is preferably circular in cross-section, and the passage is preferably annular around the conduit. There may be a plurality of passages within the wall. The conduit may have an open end, the or each passage being open at the open end of the conduit.

According to the invention there is also provided compacting apparatus comprising conveying means operable to convey material along a path, the conveying means being so arranged that the volume of material which can be conveyed in a set period of time is relatively great at the beginning of the path through the conveyor, and relatively small at the end of the path, whereby conveyed material is compacted as it moves along the path.

The volume which can be conveyed preferably decreases substantially continuously over the whole or part of the length of the path.

The conveying means may comprise a screw conveyor, such as a heavy duty screw conveyor. Preferably the screw conveyor has a pitch which is relatively large at the beginning of the path and relatively small at the end of the path. The pitch may decrease substantially continuously over the whole or part of the length of the path. Preferably the screw conveyor is located within a passage.

The conveying means may comprise a passage through which the path extends, the cross-section of the passage being relatively large at the entry to the passage, and relatively small at the exit of the passage. The cross-section preferably decreases substantially continuously over the whole or part of the length of the passage. The conveying means may be axially adjustable within the passage to vary the said volume of material which can be conveyed at any point along the passage.

The passage is preferably defined by a plurality of wall portions which are relatively movable to vary the passage cross-section. The wall portions may be resiliently biased to relative positions at which the cross-section is relatively small.

The inner face or faces of the passage wall or walls are preferably so formed as to resist or prevent conveyed material rotating about the axis of the passage. The inner face or faces may carry at least one prominence which is engageable with material in the passage. The or each prominence is preferably adjustably mounted at the passage walls, to allow the degree of projection into the passage to be varied. The or each prominence may be resiliently mounted. The or each prominence may be elongate and extend along the passage wall. The or each prominence may extend substantially parallel to the axis of the passage or may extend along a substantially helical path on the passage walls.

The conveying means may comprise blade means operable to cut conveyed material. The blade means may be toothed.

Preferably the compacting apparatus further comprises a second passage having an inlet at the end of the path through the conveying means, and an outlet, the second passage being so arranged as to resist movement of material through the passage, whereby to further compact material received from the conveying means. Movement is preferably resisted as aforesaid by friction between the material and the walls of the second passage. The resistance provided by the second passage may be variable. The second passage is preferably formed to be variable in length or may be formed to be variable in cross-section. In the former case, the second passage may be defined by two portions which may telescope together. In the latter case, the second passage may be defined by a plurality of wall portions which are relatively movable to vary the passage cross-section. The wall portions may be resiliently biassed to relative positions at which the cross-section is relatively small.

The apparatus may further comprise constriction means operable to constrict the outlet of the second passage. The constriction means may be resiliently biassed to close the outlet, whereby material is compacted until the bias is overcome.

The invention also provides compacting apparatus comprising conveying means operable to convey material to a second passage having an inlet at the end of the path through the conveying means, and an outlet, the second passage being so arranged as to resist movement of material through the passage, whereby to compact material received from the conveying means.

Movement is preferably resisted as aforesaid by friction between the material and the walls or the second passage. The resistance provided by the second passage may be variable. The second passage is preferably formed to be variable in length or may be formed to be variable in cross-section. In the latter case, the second passage may be defined by a plurality of wall portions which are relatively movable to vary the passage cross-section. The wall portions may be resillently biassed to relative positions at which the cross-section is relatively small.

The apparatus may further comprise constriction means operable to constrict the outlet of the second passage. The constriction means may be resiliently biassed to close the outlet, whereby material is compacted until the bias is overcome.

BRIEF DESCRIPTION OF THE DRAWINGS

Embodiments of apparatus according to the invention will now be described in more detail, by way of example only, and with reference to the accompanying drawings in which.

DETAILED DESCRIPTION OF THE DRAWINGS

Figure 1:
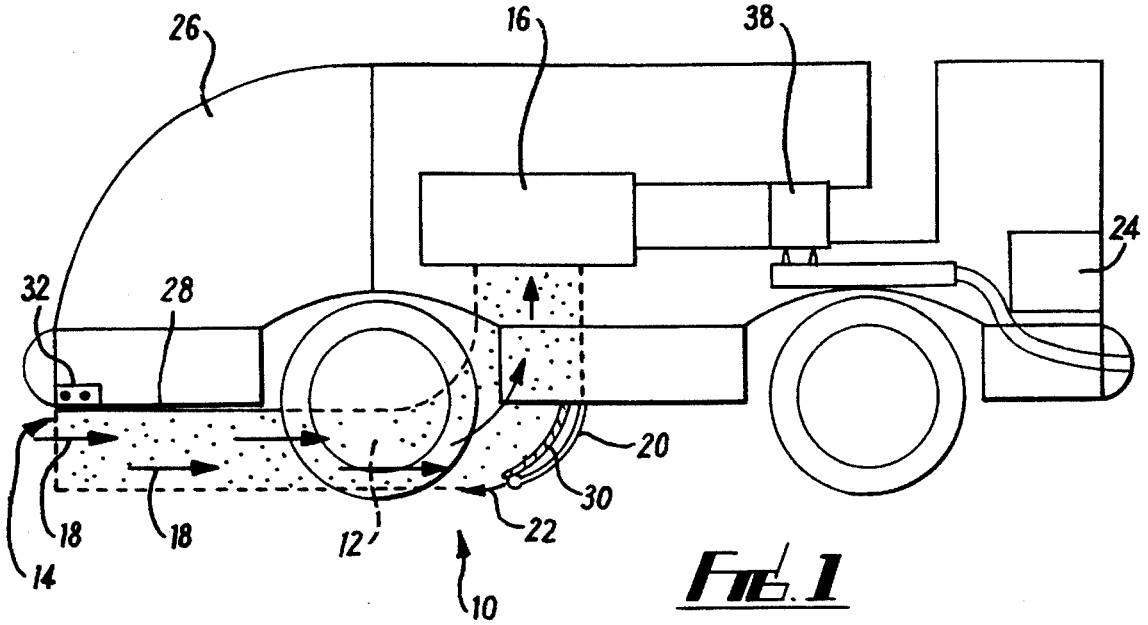
FIG. 1 is a schematic diagram of the side view of waste collection apparatus according to the present invention.
Figure 2:
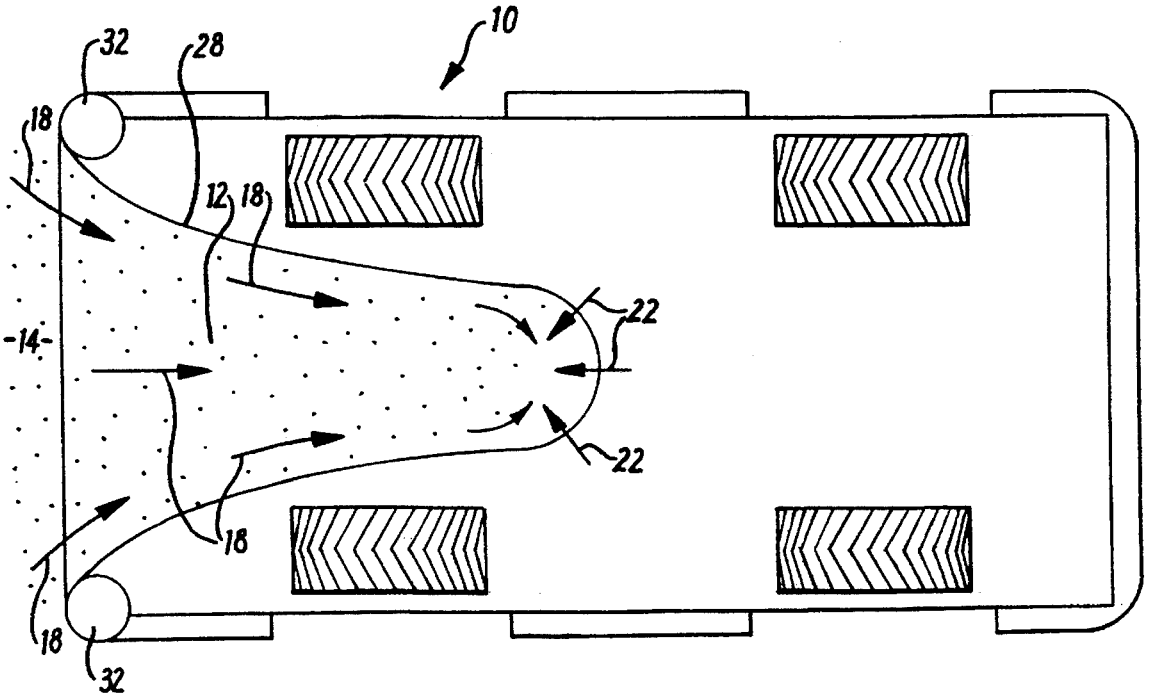
FIG. 2 is a plan view similar to FIG. 1.

Turning to FIGS. 1 and 2, there is shown waste collection apparatus 10 comprising a first fluid duct 12 having an inlet at 14, means in the form of a fan 16 operable to create a first fluid flow path illustrated by arrows 18 towards and into the duct inlet 14, whereby waste material may be drawn into the inlet 14 by the fluid flow and thereafter collected. The fan 16 is not shown in detail in FIG. 2, for clarity. The fan,could be located at any convenient position along the flow path. The apparatus may further comprise second fluid duct means 20 having outlets so located and arranged as to create a fluid flow path indicated by arrows 22 and which is at the periphery of the first path 18 and is perpendicular or generally oppositely directed to the path 18. This causes waste material which, in use, is being drawn along the periphery of the first path 18 to be deflected into the main stream of the fluid flowing along the first path.

In more detail, the apparatus is a wheeled vehicle (but could be tracked or hovering) having an engine 24, for instance a rear engine, and a cab 26 for a driver. The cab 26 is located and arranged to minimize obstructions to the view of the driver. Under the front of the vehicle 10, duct-defining surfaces 28 provide a roof and side walls for the duct 12, the floor of which is the surface over which the vehicle is moving. The duct 12 is generally horizontal and is preferably at it's widest at the inlet 14, at the front of the vehicle, and narrows in the horizontal direction back towards the middle of the vehicle, underneath the fan 16. The duct then rises generally vertically into the vehicle so that the fan 16 can act to create a draught of air along the duct 12 and up into the vehicle 10. This draught causes litter within the duct to be accelerated back towards the location at which the duct 12 turn upwards. Litter can be carried along by this air flow. The relatively slow flow at the forward, inlet end of the duet 12 may be sufficient to cause wind blown litter to be drawn into the duct 12, but need not be sufficient to move heavier objects. Wind blown litter will accelerate along the duct, until it is moving sufficiently quickly, when it reaches the upward turn, to be carried up with the airflow into the machine, even if the suction at that point is insufficient to lift heavier objects.

The speeds are preferably set to allow litter to be collected without disturbing the underlying surface for operation over grass or similar surfaces, a comb or other device may be used to dislodge or disturb material to be collected.

To assist in the deflection or litter up into the vehicle, a baffle 30 is slung beneath the vehicle 10 to guide litter up info the vehicle. In order to avoid excess wear of the baffle 30, it is made slightly short so that it does not bear on the surface over which the vehicle is moving. This gives rise to a risk that litter travelling along the lower periphery of the duct 12 may leave the duct through the gap between the baffle 30 and the surface below, although windblown litter will tend to be pulled up by the airflow. Second ducts 20 may be used to help overcome any tendency to leave the duct 12. These ducts 20 may be supplied with pressurised air in order to direct jets of air from the lower edge of the baffle 30 back along the lower periphery of the duct 12, towards the inlet 14, or a gap can be left to allow air to be drawn under the baffle 30. Consequently, litter travelling along the lower periphery of the path 18 will be deflected by the jets from the ducts 20 up towards the main stream of the path 18, so that the litter will again be caught up by the main flow of air along the duct 12, and so be carried into the vehicle.

Figure 3:
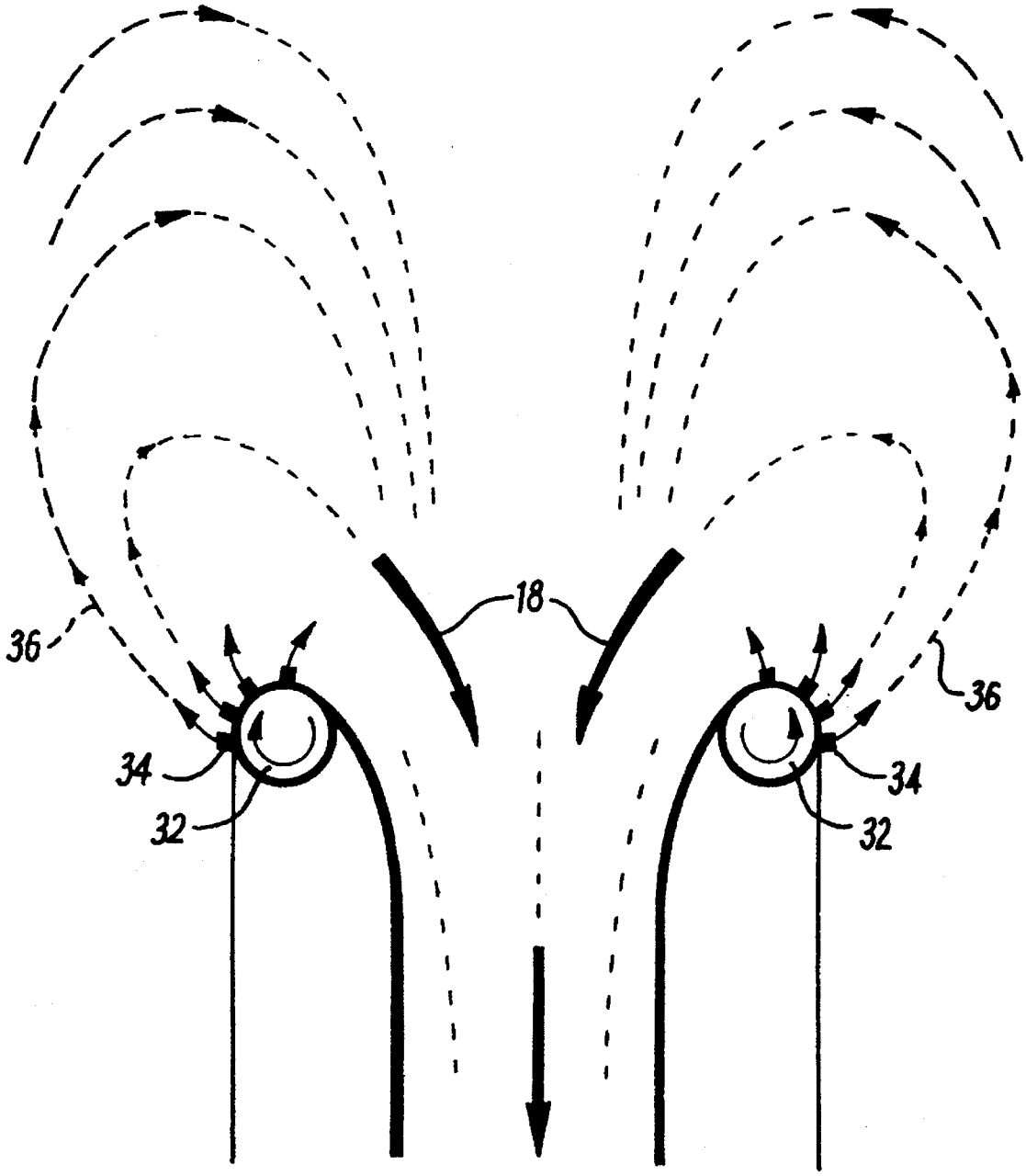
FIG. 3 is a schematic plan view illustrating the operation of rotating collecting jets.

Located on opposite sides of the inlet 14 are two air jet assemblies 32 whose function is described more easily with reference to FIG. 3. Each has a plurality of air outlets located around its circumference, and is mounted statically or for complete or partial rotation about its centre by means not shown in the drawings, but which may be conventional in themselves. The outlets 34 of the jets 32 are supplied with pressurised air, so that in use, each outlet 34 creates a jet 36 of air directed down to the ground slightly in front of the vehicle. Each jet 36 sweeps an area of ground in the region of the inlet 14 and by virtue of the locations of the jets 32, these regions are at the periphery of the air paths 18 into the duct 12. The jets 32 rotate in opposite directions so that the jets 36 sweep in towards the path 18. Consequently, as the apparatus approaches items of litter, and especially wind blown litter, these articles are deflected by the jets 36 and swept in towards the centre line of the apparatus, so that they will be drawn into the air entering the duct 12, and will therefore be carried into the vehicle for collection. The sweeping motion of the jets 36 reduces the possibility of wind blown litter being deflected away from the vehicle, and can reach under obstructions or into relatively inaccessible locations to retrieve litter.

It may be possible to use fixed jets 36, or moving jets. These may rotate continuously, or oscillate, in which case the jets will be turned off on the return sweep, to avoid deflecting litter away from the ducts. Consequently, the jets 36 may supply fluid to the second outlets 34 in pulses.

The jets 36 also increase the width of the swath cleared by the machine, beyond the width of the machine. Some material may nevertheless be too far away to be collected, even by the action of the jets 36. Such material may nevertheless be blown by the jets, away from the machine. The machine will leave a swath from which material has been collected, and which is bordered by strips from which material has blown away. Thus, to achieve substantially complete clearance of a large area it is not necessary for neighbouring swaths cleared by the machine to be contiguous, but only that the border strips of neighbouring swaths are contiguous or overlap. This reduces the required number of passes of the machine.

Within the vehicle 10, the air being drawn along the duct 12 is conveyed, along with any litter transported with it, to the fan 16 which is creating the air movement. The shredded waste passes from the fan 16 to a filler 38 for extracting the litter from the air flow. Possible designs of filter 38 are shown in more detail in FIGS. 4 and 5. The fan 16, if upstream of the filter 38, shreds any waste brought in by the air flow, and may include cutting edges for this purpose.

Figure 4:
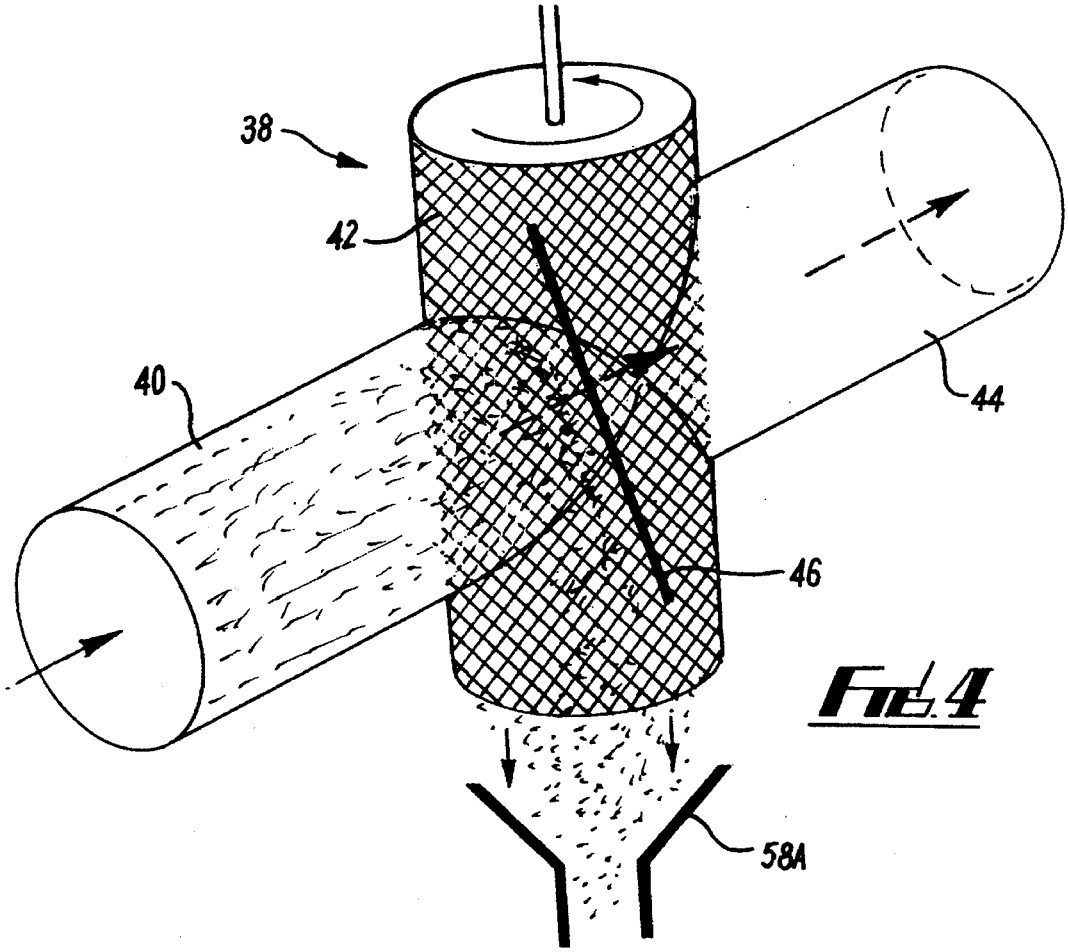
FIGS. 4 and 5 are schematic perspective views of filtering apparatus for use in the apparatus of FIGS. 1 to 3.

In FIG. 4, a duct 40 conveys air from the fan 16 towards a vertical and hollow cylinder 42 of filter material such as a wire gauze. The duct 40 directs the air flow through the cylindrical wall of the cylinder 42, so that the air passes across the hollow interior of the cylinder 42, and out of the cylinder through the cylindrical wall on the far side, where it is collected by a further duct 44. The cylinder 42 is mounted for rotation about its vertical cylindrical axis and is constantly rotated during use. Accordingly, air carrying shredded waste from the fan 16 leaves the duct 40 and is filtered to leave the waste material on the outer cylindrical surface of the cylinder 42. The material may fall off the cylinder 42 of its own accord, or be scraped off the cylinder as the cylinder rotates past a fixed scraper 46, or be blown off by air jets (not shown). The scraper 46 is located at an intermediate position between the position at which air leaves the duct 40 to pass through the cylinder 42, and the position at which air passes through the cylinder 42 to enter the duct 44.

Air reaching the centre of the cylinder 42 will consequently be substantially clean. Furthermore, the cylinder 42 will also be substantially clean in the region through which the air passes to enter the duct 44. However, any small amounts of waste which may remain attached to the outer surface of the cylinder 42 will tend to be blown off by the air entering the duct 44, thus leaving the surface of the cylinder 42 substantially clean. Any small amounts of waste which are carried along the duct 44 can be filtered out in a subsequent filtering stage, by conventional means.

It can be seen from the above that the filter apparatus has a form of self-cleaning action, because the air being filtered passes through the cylinder 42 in a first direction to be filtered, and then back through the cylinder 42 in the opposite direction relative to the cylinder surface, to perform a cleaning action. Alternatively, cleaning could be performed by a separate air supply.

Figure 5:
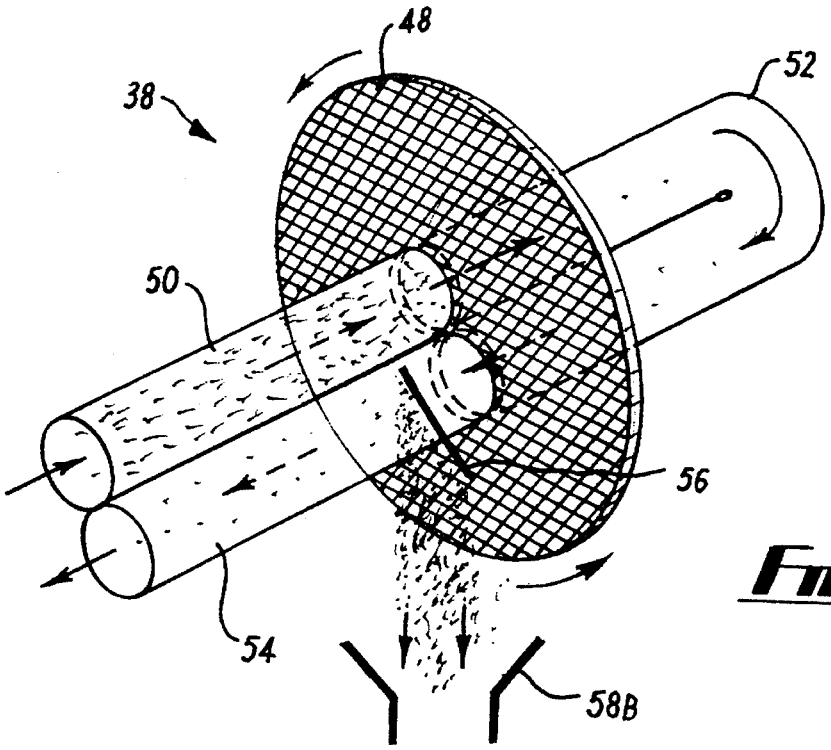

A second alternative is shown in FIG. 5. This arrangement uses a disc 48 of filter material which is mounted to rotate about its centre. Associated ducts 50, 52 and 54 provide a path for air which enters the duct 50 from the fan 16, passes through the filter disc 48 into one end of the duct 52, and then is re-directed to pass back in the opposite direction through the disc 48 into the duct 54 which conveys the substantially clean air away from the filter. The rotation of the disc 48 causes the filter material of the disc to describe a circular path from the region between the ducts 50, 52, in which the bulk of the shredded waste is filtered out from the air, to a second position between the adjacent ends of the duct 52 and the duct 54. Before reaching the second position, the filter material is scraped by a scraper 56 (or cleaned by air jets) to remove the majority of material collected by the filter disc 48. Any remaining material which is carried by the disc 48 as it reaches the second position will tend to be blown off by the air passing back to the duct 54, so that the disc 48 is left clean. The air leaving the duct 54 may contain small amounts of waste material which can be filtered out in a subsequent operation by conventional apparatus. It may not be necessary to redirect all of the air through the filter, but to use only part of the filtered air to clean the filter. The rotating filters may operate satisfactorily without a reverse air flow for cleaning.

Figure 6:
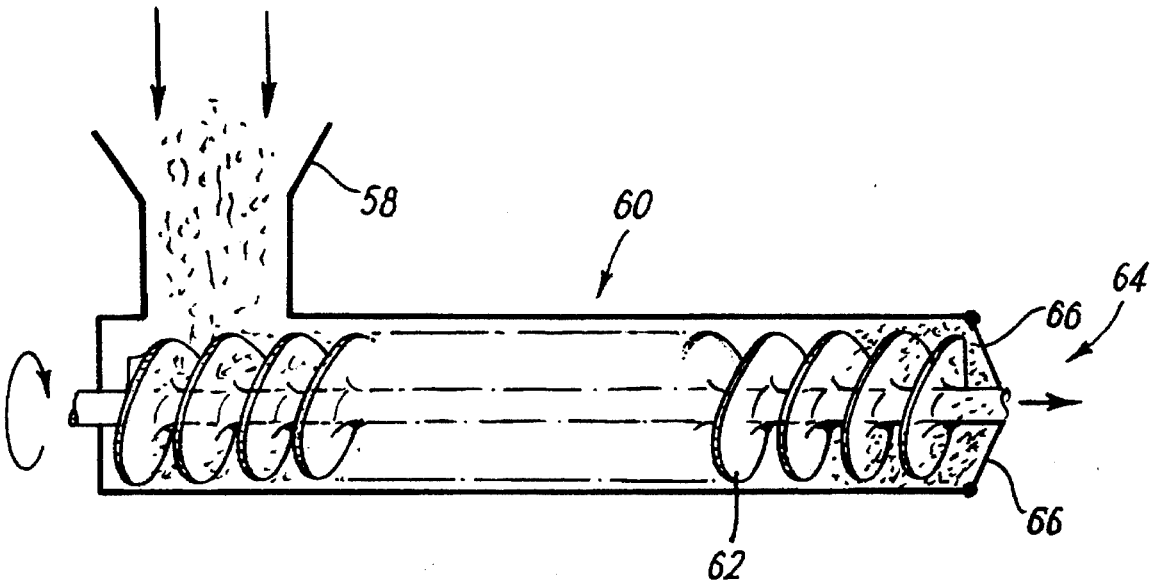
FIG. 6 is a schematic diagram of a first litter compression arrangement for use in the apparatus of FIGS. 1 to 3.

The waste material recovered from the filter disc 48 or the filter cylinder 42 falls into a collecting mouth 58A, 588 located beneath the filter. Whether the filtration is effected by the apparatus described above, or by conventional apparatus, the material recovered by the filters is supplied to a compacter apparatus 60 shown in FIG. 6. The compacter 60 comprises a screw conveyor 62 which receives at one end the debris falling from the filter, through the mouth 58. This waste is conveyed by the rotation of the conveyor 62 towards an outlet at 64. Spring mounted doors 66 are located at the outlet 64 and are sprung to their closed position. Consequently, as the conveyor 62 continues to move debris towards the outlet 64, the debris will become compacted until the degree of compaction forces the doors 55 to open against their spring bias, to allow a compacted parcel of litter to leave the outlet 64. The compacted packet may have been sufficiently compacted to retain its shape without assistance, or may then if required or desired be placed in a bag or sack, or bound or tied to form a bail. Each packet can then be released from the vehicle for subsequent collection. This contrasts with previous proposals in which collected litter is stored on board the collecting vehicle, causing the size and weight of the vehicle to increase and the range of the vehicle to reduce. By jettisoning packets of litter, the vehicle is kept as light as possible so that it can be used on a wider range of surfaces, such as grass, sand, gravel and steep slopes. It is believed that it will be relatively easy in practice to arrange for transport of the packets either manually or by an appropriate form of transport to a road vehicle at a nearby location, which can then transport the packets to a waste disposal location. In some applications, it may be convenient to tow a trailer on which the packets can be stored.

In an alternative, a piston cam compressor could be used instead of the screw conveyor, or to further compress the material previously compressed by the screw conveyor.

In order to extend the range over which the vehicle can collect litter, it is provided with a hose 70 mounted on a boom 72 which can be raised, lowered and swung in conventional manner to move the hose 70. The hose and boom together provide a path 74 for air through which waste may be drawn from the end of the hose 70 into the vehicle 10, by suction. Suction may be created by the fan 16 or by a separate fan, or the fan may be selectively connectable to the hose 70 or for collecting through the duct 12. The hose 70 can be connected through the duct 12. Any waste collected by the hose 70 is dealt with in the same way as waste collected by the duct 12.

Figure 7:
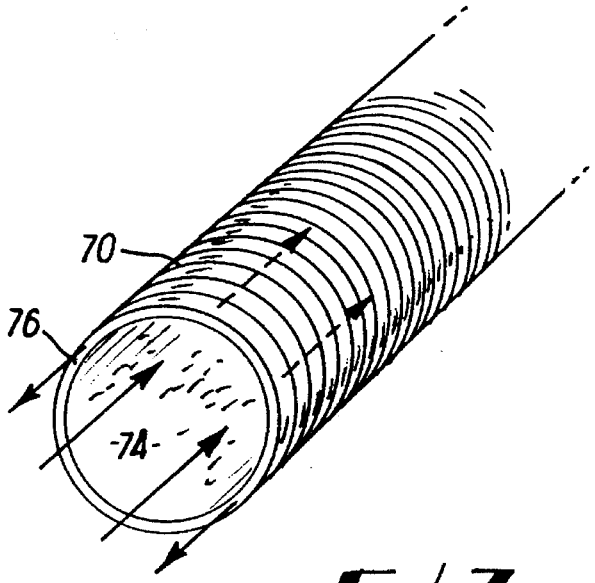
FIG. 7 is a schematic diagram of the end of an elongate article according to the present invention.

The hose 70 is made of flexible material. The wall of the hose 70 is multi-skinned to leave one or more narrow annular passages 76 between the inner and outer skins. Only one annular passage is illustrated in FIG. 7, which shows the end of the hose 70. It 1s apparent from that drawing that the passage 76 is open at the end of the hose 70, around the mouth of the path 74. Alternatively the passage 76 may be closed.

Figure 8A:
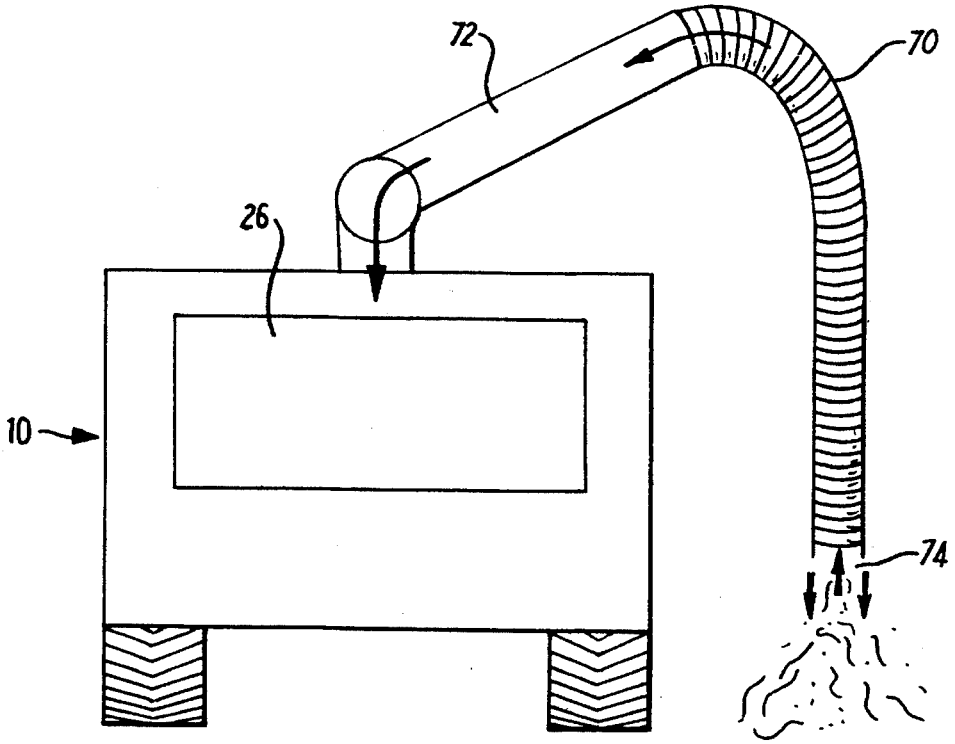
FIGS. 8A and 8B illustrate the elongate article of FIG. 7 in use.
Figure 8B:
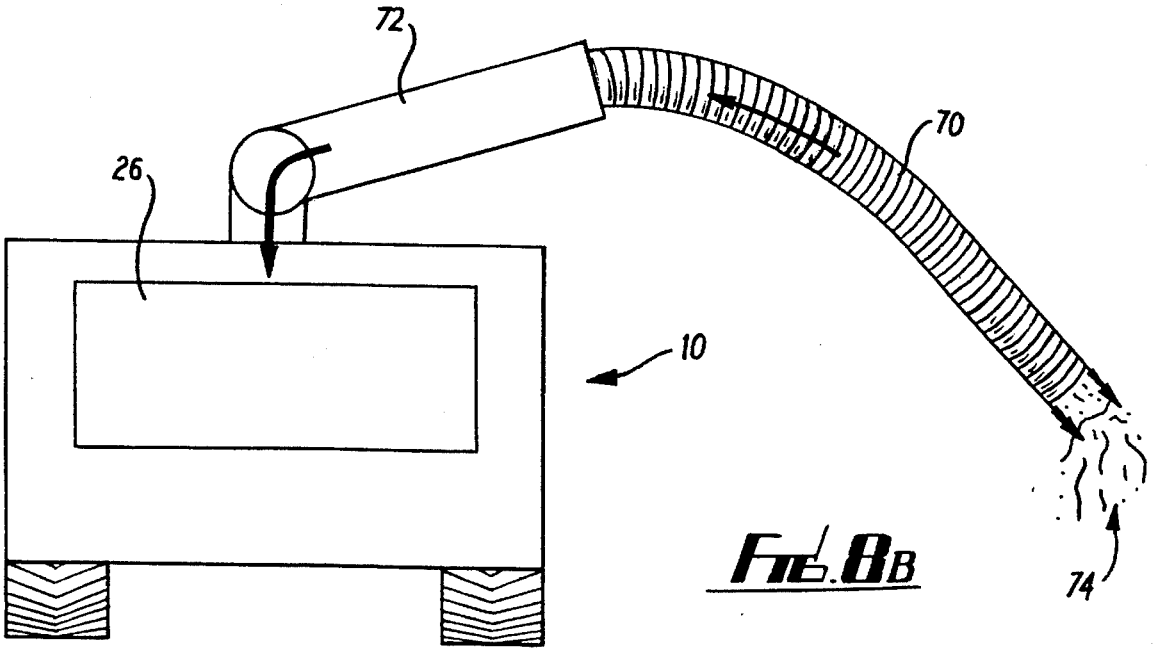

Air is supplied under pressure to the passage 76 at the end of the boom 72 and flows along the passage. The air will leave at the end of the hose 70 if the end is open. The operator is provided with controls which allow the pressure of air supplied to the passage 76 to be varied, so that the passage 76 can be inflated to a variable degree, and this in turn allows the flexibility of the hose to be varied. In general, the higher the pressure supplied to the passage 76, the more rigid will be the hose. This provides a further freedom to the operator for controlling the position of the end of the hose 70, because he can move the boom 72 and also vary the flexibility of the hose 70, so that it reaches out to varying degrees from the vehicle 10. This is illustrated in FIGS. 8A and 88. FIG. 8A shows the position when a relatively low pressure is supplied to the passage 76. The hose 70 hangs limply from the boom 72. If the pressure to the passage 76 is increased, the hose 70 becomes less flexible and reaches out further from the vehicle. It is envisaged that the air pressure required to control the flexibility of the hose may be many times greater than the air pressures required to provide adequate suction into the path 74. Thus, the pressure in the passage 76 will dominate the control of the hose flexibility.

In addition controlling the flexibility of the hose, air leaving the passage 76 may act in a similar manner to the air jets 36 of FIG. 3, to deflect litter into the path 74.

It will be apparent from the above description that the vehicle operates mainly by air flow, rather than by brushing, so that problems of dust are less serious.

As has been described, the range of terrains over which the vehicle may be operated is extended by not storing the collected litter in the vehicle. The range of operating conditions may be further extended by designing the vehicle to be as low as possible so that it can be operated under obstruction such as shop canopies and in multi-storey carparks. The stability of the vehicle can be improved by mounting all heavy machinery such as the fan as low as possible on the chassis.

The versatility of the machine before collecting begins can be improved by providing an arrangement which allows the ground clearance at the front and/or rear of the vehicle to be increased. This may be achieved by raising the duct-defining surfaces, or by raising the complete vehicle in relation to the wheels, e.g. by adjusting the vehicle suspension through mechanical, hydraulic or air suspension.

Couplings may be provided to allow the fan 16 or other elements of the machine (such as a compressor) to be used for other purposes, when the machine is not collecting, such as providing power for other equipment.

The apparatus has been described above in relation to air flows etc., and for use on land. A water-borne vessel is also envisaged, in which the fan 16 is replaced by a pump, and water is drawn through the duct 12 or hose 70. In the land version, the fan 16 can be replaced by other means for creating the necessary air flow, such as an air jet in place of the fan and directed across the duct to create an air flow.

The remaining drawings show an alternative form of compactor, which may be used in place of the compactor 60.

Figure 9:
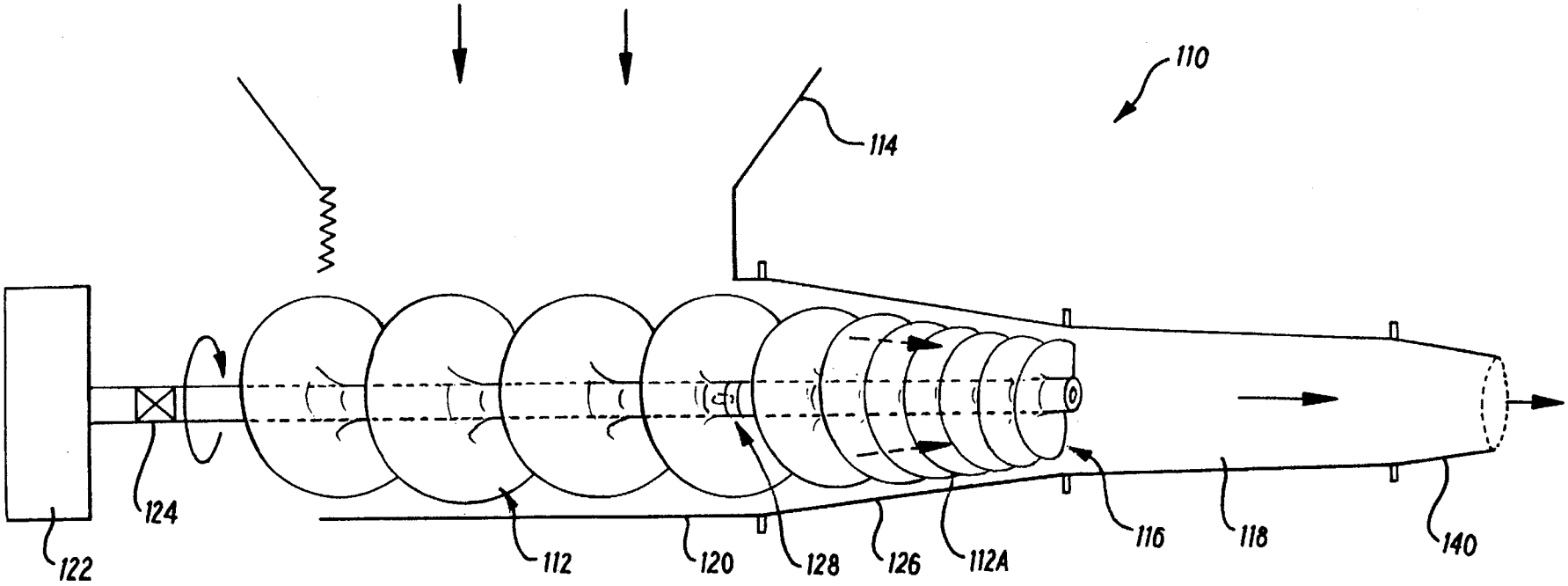
FIG. 9 is a schematic side elevation of compacting apparatus according to the present invention.

Turning to FIG. 9, there is shown compacting apparatus 110 which comprises conveying means indicated generally at 112 and operable to convey material from an inlet chute 114 to an outlet at 116 from where the material enters a back pressure chamber 118 to be described in more detail later. The conveying means 112 is in the form of a screw conveyor. Appropriate modification of the screw diameter and thread pitch of the screw 112 allow a greater volume of material to be conveyed in a set period of time in the region of the chute 114, than at the outlet 116. As a result, material being conveyed is compacted as it moves along the path, as will be described.

In more detail, the screw 112 is located in a passage 120 and driven by an appropriate drive mechanism 122 through a coupling at 124 which may be a universal joint allowing some relative movement of the screw 112 and the drive 122. Alternatively, the drive 122 and screw 112 may be movable together, relative to the passage 120. The passage 120 is open to receive material from the chute 114. In the arrangement shown, material is fed by gravity from the chute, which is above the passage 120. The screw 112 has a relatively large diameter and large pitch length adjacent the chute 114, so that relatively large volumes of material can be conveyed away from the chute.

Material is conveyed toward the outlet 116. Before reaching the outlet 116, the material passes through a tapering section 126 of the passage, referred to as a compaction chamber. The compaction chamber 126 is shown as frustoconical, decreasing in diameter uniformly and continuously towards the outlet 116. Other shapes could be used, which need not be uniform or continuous.

A portion 112A of the screw 112 extends into the compaction chamber 126. The portion 112A may be connected to the main screw 112 by a coupling or couplings at 128 which may be similar to the coupling 128 or the whole screw may be one piece. The screw 112A has a decreasing diameter toward the outlet 116, to generally follow the internal shape of the compaction chamber 126. In addition, the pitch of the screw 112A reduces toward the outlet 116. This reduces the volume of material which the screw 112A can move through the outlet 116, in relation to the volume the main screw 112 can draw from the chute 114. However, the screw 112 and the screw 112A rotate together. Consequently, material drawn from the chute 114 slows down as it passes through the compaction chamber towards the outlet 116 and is therefore compacted. The decrease in the diameter and thread in the compaction chamber 126 causes this compaction to be produced gradually through the length of the compaction chamber 126, but compaction need not be continuous along the whole length.

The compaction chamber 126 may be formed by separate wall portions which are relatively movable to vary the passage cross-section and taper. They may be resiliently biassed towards a position at which the cross-section is relatively small.

Figure 10:
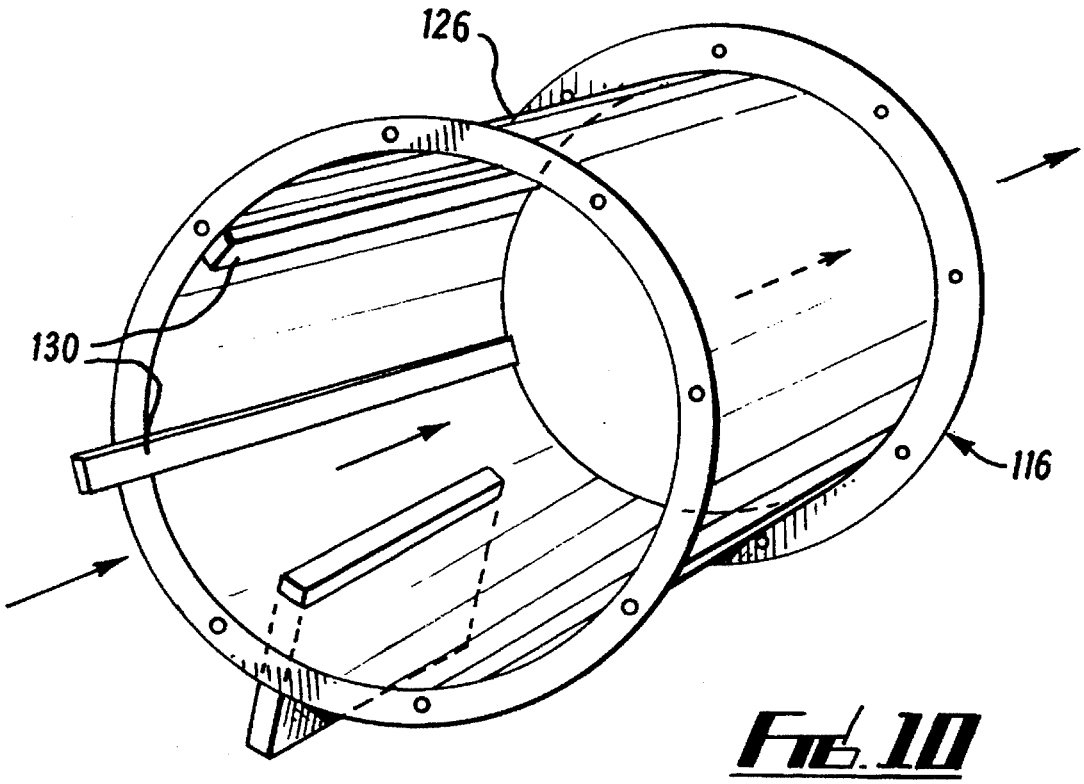
FIG. 10 is a schematic perspective view of part of the compaction chamber walls of the apparatus of fig.
Figure 11:
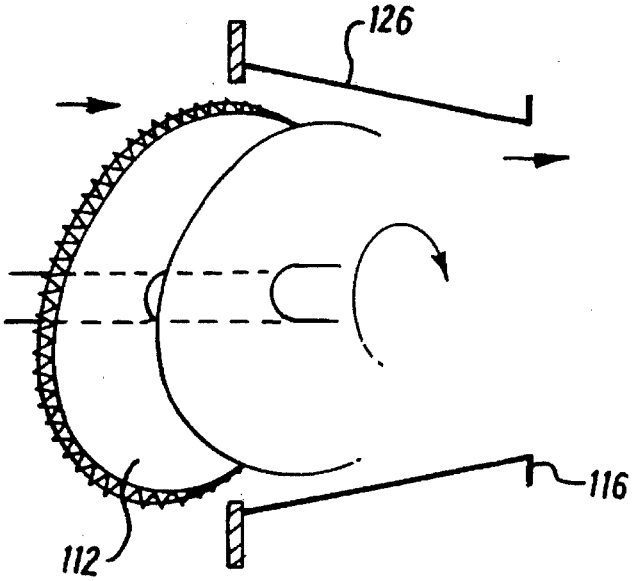
FIG. 11 is a partial schematic elevation of part of FIG. 9, on an enlarged scale.

The material passing through the apparatus will normally resist compaction to a degree which depends on the nature of the material and the degree of compaction created. This may result in a tendency for partially compacted material to rotate with the screw 112 or 112A, rather than being conveyed by it to be further compacted. The apparatus would then cease to function. To avoid this, the inside surfaces of at least the compaction chamber 126 are formed to resist or prevent the conveyed material from rotating about the axis of the passage, by providing prominences 130 in the form of fins shown in FIG. 10. The fins 130 extend along the walls of the compaction chamber 126 and project into the chamber to engage material within. Thus, the material can relatively easily slide past the fins along the length of the passage, but the fins resist any tendency of the material to rotate. The fins 130 may be permanently fixed in position, but preferably are adjustable so that the extent to which they project into the compaction chamber 126 can be varied according to the nature of the material being compacted and to compensate for wear. The fins 130 may be resiliently mounted and biassed toward the position at which they project most into the chamber 126. The fins 130 may be straight and run along the passage walls parallel to the passage axis, as shown in FIG. 10, or could extend along a generally helical path.

It is necessary to ensure that the fins 130 do not foul the rotating screw 112A. For this purpose, it is preferred to allow the axial position of the screws 112, 112A to be adjustable to ensure adequate clearance. The required degree of clearance may depend on the nature of the material being compacted. Alternatively, the fins can act as bearings or constraints locating the screw 112A radially on flexible mountings. The fins 110 may extend back from the compaction chamber 126 into the parallel-sided portion of the passage, around the main screw 112. One fin 130 is shown in FIG. 10 with extra length for this purpose. In addition to the fins 130, or as an alternative, the inner surfaces of the compaction chamber 126 can be treated in other ways to enhance friction between the surface and the material being conveyed.

Compaction of the material may be further enhanced by providing the screws 112,112A with roughened, sharpened or toothed threads which will cut into any material which penetrates between the screws and the passage walls, thereby tending to break down the material into smaller pieces which are more easily compacted.. The fins 130 provide an anvil for cutting in this manner.

When the apparatus which has been described is in use, the screws 112,112A rotate. Material enters the passage from the chute 114 and is conveyed toward the outlet 116. As the material moves towards the outlet 116, particularly in the compaction chamber 126, the volume of material which the screw 112A can convey over a given distance by one rotation is reduced. Thus, a greater volume of material enters the compaction chamber 126 in a given time than leaves it. The result is to compact the material within the chamber to a degree determined by the taper, the change in the thread pitch and the compaction chamber shape.

The compaction which is achieved can be further increased by using the back pressure chamber 118 shown in FIG. 9. In its simplest form, the chamber 118 is a cylindrical tube of circular section through which material from the outlet 116 must pass before finally leaving the apparatus. The diameter of the chamber 118 is the same as or similar to the diameter of the outlet 116. Accordingly, as the material which has already been compacted passes through the chamber 118, friction is created between the material and the walls of the chamber 118. This creates a resistance to movement of the material, resulting in effect in a back pressure at the outlet 116. The screws 112,112A must therefore convey material against this back pressure, which results in further compaction.

Figures 12, 13:
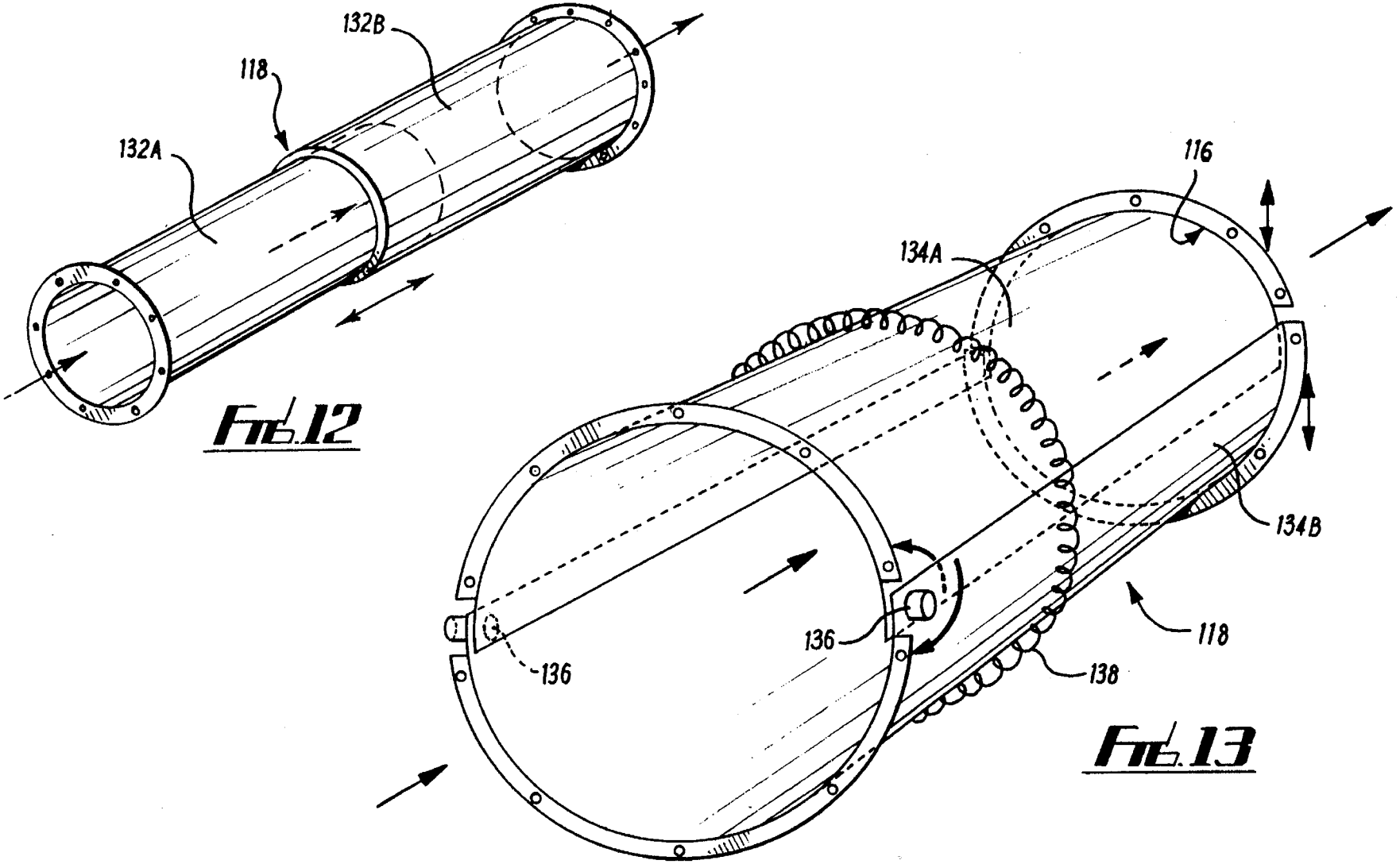
FIGS. 12 and 13 are schematic perspective views of back pressure chambers used in the apparatus of FIG. 9.
Figure 14:
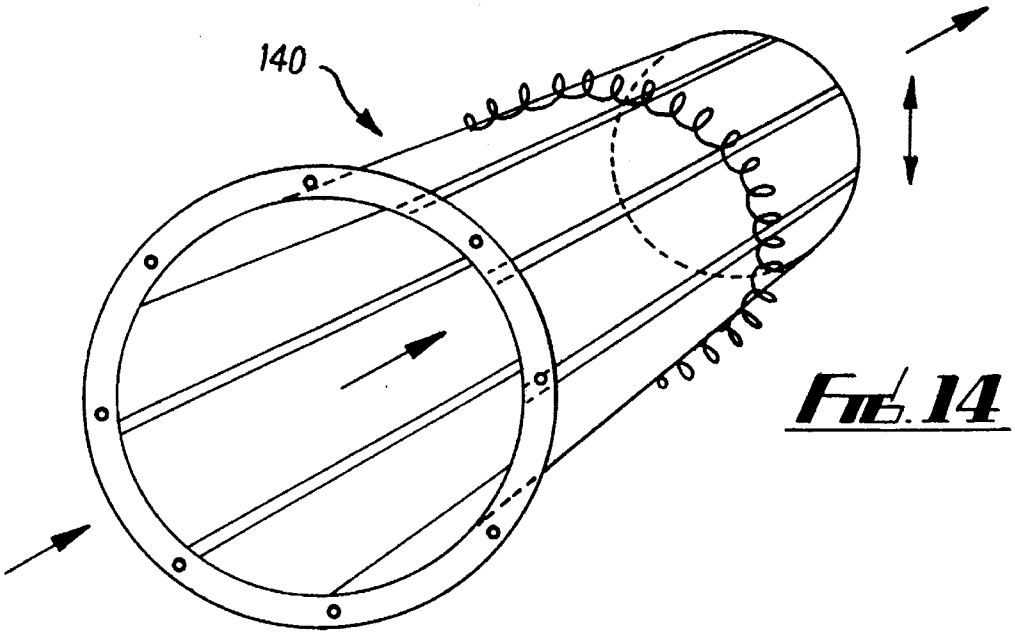
FIG. 14 is a schematic perspective view of an extrusion nozzle for use in the apparatus of FIG. 9.

FIGS. 12 and 13 show alternative forms of compaction chamber which allow the degree of back pressure to be varied. In FIG. 12, the chamber consists of two portions 132A,1328 of approximately the same internal size but which can telescope one within the other to vary the overall length of the chamber 118. This varies the total frictional force created within the chamber 118, thereby varying the back pressure produced.

In FIG. 13, the chamber 118 is formed by two portions 134A,1348 which are each semi-cylindrical. The two portions are pivotally connected at 136, at the end of the chamber 118 to be attached in use to the outlet 116. The pivot 136 allows the portions 134A,B to move toward or away from each other thereby creating a tapering passage with a variable degree of taper. Various means may be provided to control the degree of taper. A spring 138 or other resilient member can be placed around the portions to urge them together but to allow them to move apart as material is forced between them.

The downstream end of the back pressure chamber 118 is connected to an extrusion nozzle 140 which may be a short frusto-conical extension of the chamber 118, or may be formed to restrict or close the downstream end of the chamber 118, preferably resiliently. This allows the degree of compaction to be further increased, by increasing the back pressure, and also allows the final cross-section of the compacted material to be determined by the cross-section of the nozzle 140.

It will be apparent that the back pressure created downstream of the outlet 116 will affect the operation of the screw 112,112A. In particular, it may affect the tendency of material to rotate with the screw, rather than being compacted. In practice, it is therefore likely to be necessary to adjust the screws, fins and chamber 118 together, until a satisfactory degree of compaction is achieved. The nature of the material being compacted would also be relevant in setting up the apparatus, for instance because the degree of friction between the material and the apparatus will depend on the nature of the material. Thus, it may be appropriate to resiliently mount 811 adjustable parts of the apparatus, so they may be biassed towards the position which provides greatest compaction. Excessive compaction will then tend to work against this resilient bias until a state of balance is achieved.

Figure 15:
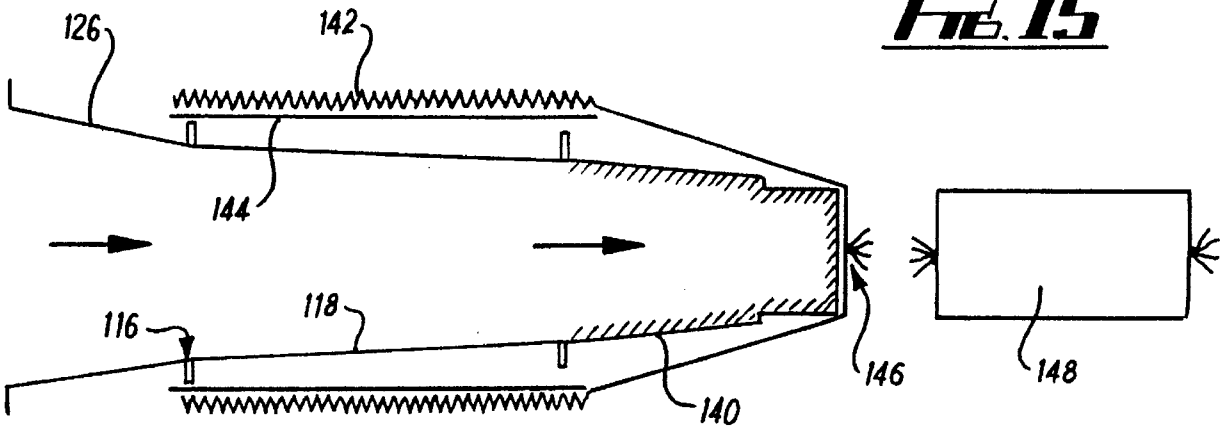
FIG. 15 is a schematic vertical section through part of the apparatus of FIG. 9 during use.

Compacted material leaving the nozzle 140 can be formed into packages by an arrangement illustrated in FIG. 15. A long lube of material 142, such as a plastics material, is supported around the chamber 118 in an axially contracted slate. The lube 142 may be carried by a cardboard or other former 144. In use, the lube 142 is closed downstream of the nozzle 140, at 146, for instance by tying off. As material is extruded from the nozzle 140, it pushes against the lube 142, thereby drawing off further material from the former 144 to encapsulate the material in the plastic tube 142. When the package has reached an appropriate length, the extruded material and the tube 142 can be cue and the tube tied off again to form a completed enclosed package 148.

The combination of compaction provided in the apparatus, and cutting effects provided by sharpened, roughened or toothed screws 112,112A is expected to result in compacted material which is relatively unlikely to try to return to its original shape and volume. Furthermore, any sharp prominences at the outside surfaces of the extruded material will tend to have been blunted or pushed into the body of the material as it passes through the chamber 118. Consequently, it is expected that the compacted material will largely remain in its compacted state so that the plastics lube 142 is merely required to cover the material for protection purposes, rather than to hold the compacted material in a compacted state. It is expected that the present invention will allow material to be more densely compacted than conventional techniques, and to have a significantly reduced tendency to expand again.

The drive 122 may be arranged to sense the torque being applied to the screw. This allows the drive to detect if the apparatus becomes jammed, for instance by incompressible material. If excessive torque is detected, the drive may reverse for a short period, to try to clear the blockage. If several attempts to clear the blockage fail, the reverse rotation can be continued until the blockage is cleared out of the end of the passage nearest the drive. That end would need to be opened or openable for the purpose.

The apparatus which has been described is preferably made in a large number of parts which are assembled for use. In particular, the compaction chamber is preferably separable from the back pressure chamber 118, and main passage 120, and the extrusion nozzle 140 may be detachable from the chamber 118. The screw 112A is separable from the screw 112 (but driven by it in use). The result is to allow various parts to be removed and replaced or adjusted for maintenance, or as a result of wear, or to cope with various different materials.

The apparatus which has been described is expected to provide a very high degree of compaction in comparison with conventional techniques. This is expected to allow the apparatus to be relatively small. This, together with expected low noise levels and the ability to package compressed waste will allow the apparatus to be used in locations where similar apparatus would not otherwise be acceptable. The apparatus can be used as a separate device for compaction of material, or can be incorporated into other equipment performing other tasks.

Many variations and modifications can be made without departing from the scope of the present invention. Other forms of conveyor could be used and other arrangements could be made for varying the compaction achieved, including varying the back pressure. The apparatus may be particularly useful to provide preliminary compaction of material before further compaction in a machine of conventional design, or alternatively, the apparatus could receive material which has been partially compacted in apparatus of conventional design.

It will be apparent from the above description that many variations and modifications to the apparatus described can be made without departing from the spirit and scope of the present invention, Various elements of the apparatus can be used separately. For instance, the compactors can be used alone, to provide compaction of waste or other material collected by other means.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A waste collection apparatus for movement over a supporting surface in at least a forward direction, said apparatus comprising:

(a) a first fluid duct defined by walls, and including an unobstructed inlet and an upwardly-turned feed section for directing waste material upwardly into a body of the apparatus, said first fluid duct extending generally horizontally from the inlet opposite the direction of forward movement of the apparatus to the feed section;

(b) fluid flow means communicating with said first fluid duct, and operable to create a fluid flow along the first fluid duct from the inlet to the feed section, said fluid flow means creating a wind of sufficient strength through the first fluid duct to cause substantially only wind blown litter to be drawn across the supporting surface through the first fluid duct;

(c) the inlet of said first fluid duct having a cross-section greater than the cross-section of said feed section for causing the fluid flow along the duct to accelerate from the inlet to the feed section, thereby accelerating the flow of waste into the apparatus for collection;

(d) at least one second fluid duct means communicating with said fluid flow means and having at least one outlet located in the region of the duct inlet and arranged as to direct fluid leaving the at least one outlet to create a second fluid flow path along the periphery of the first path to cause waste material which is being drawn along the periphery of the first path to be deflected into the main stream of fluid flowing along the first path; and (e) means for re-orienting the at least one outlet of the at least one second fluid duct means at the duct inlet of the first fluid duct, whereby the second flow path is re-oriented in relation to the first fluid flow path.

2. The apparatus according to claim 1, comprising at least two outlets located opposite one another in the region of the duct inlet.

3. The apparatus according to claim 2, wherein each outlet is pivotally or rotatably mounted, whereby the second flow path may sweep through a region at the periphery of the first flow path.

4. The apparatus according to claim 3, wherein a plurality of pivotally or rotatably mounted outlets are operable to create respective second flow paths which sweep in succession through a region at the periphery of the first flow path.

5. The apparatus according to claim 1, comprising means for supplying fluid to the second outlets in pulses.

6. A waste collection apparatus comprising a first fluid duct having an inlet, means operable to create a first fluid flow path towards and into the duct inlet whereby waste material is drawn into the inlet by the fluid flow and thereafter collected, and wherein the apparatus further comprises at least one second fluid duct means having at least one outlet located in the region of the duct inlet and arranged as to direct fluid leaving the at least one outlet to create a second fluid flow path along the periphery of the first fluid flow path to cause waste material which is being drawn along the periphery of the first fluid flow path to be deflected into the main stream of fluid flowing along the first fluid flow path, and means for re-orienting the at least one outlet of the at least one second fluid duct means at the duct inlet of the first fluid duct, whereby the second fluid flow path is re-oriented in relation to the first fluid flow path.

7. The apparatus according to claim 6, wherein the apparatus is adapted to move over a surface, the duct being partly defined by the surface and partly by a duct-defining surface of the apparatus, and the or one of the second fluid duct means having an outlet in the region of an edge of the duct-defining surface adjacent to the surface over which the apparatus is moving, and the second path being so directed to deflect waste material from leaving the duct between the edge and the surface over which the apparatus is moving.

8. The apparatus according to claim 6, wherein the portion of the duct which is defined in part by the surface over which the apparatus is moving is generally horizontal and turns upwardly in the region of said edge, to draw waste material up from the surface.

9. The apparatus according to claim 6, wherein the duct generally converges, whereby fluid accelerates as it travels along the first path.

10. The apparatus according to claim 6, wherein the second fluid duct means comprise at least two outlets located opposite one another in the region of the duct inlet.

11. The apparatus according to claim 6, wherein the outlet is rotatably or pivotally mounted, whereby the second flow path may sweep through a region at the periphery of the first flow path.

12. The apparatus according to claim 11, wherein a plurality of rotatably or pivotally mounted outlets are operable to create respective second flow paths which sweep in succession through a region at the periphery of the first flow path.

13. The apparatus according to claim 10, further comprising means for supplying fluid to the outlet in pulses.

* * * * *